US007971519B2

(12) United States Patent
Annebique et al.

(10) Patent No.: US 7,971,519 B2
(45) Date of Patent: Jul. 5, 2011

(54) APPARATUS FOR HYDRAULICALLY ADJUSTING THE BLADES OF AN IMPELLER OF AN AXIAL-FLOW FAN

(75) Inventors: André Annebique, Homburg (DE); Jörg Schmidt, Zweibrücken (DE)

(73) Assignee: TLT-Turbo GmbH (DE)

( * ) Notice: Subject to any disclaimer, the term of this patent is extended or adjusted under 35 U.S.C. 154(b) by 454 days.

(21) Appl. No.: 12/043,416

(22) Filed: Mar. 6, 2008

(65) Prior Publication Data

US 2008/0219846 A1 Sep. 11, 2008

(30) Foreign Application Priority Data

Mar. 9, 2007 (DE) ..... 10 2007 011 990

(51) Int. Cl.
*F01B 25/02* (2006.01)
*F15B 13/04* (2006.01)
*F16D 31/02* (2006.01)

(52) U.S. Cl. ..... 91/6; 91/445; 60/403

(58) Field of Classification Search ..... 60/403, 60/405, 406; 91/6, 445
See application file for complete search history.

(56) References Cited

U.S. PATENT DOCUMENTS 3,722,365 A * 3/1973 Olsson ..... 91/445
4,065,094 A * 12/1977 Adams ..... 60/405
4,348,155 A 9/1982 Barnes et al.
4,915,613 A * 4/1990 Landis et al. ..... 431/6
5,454,291 A * 10/1995 Ulm et al. ..... 91/445
5,836,743 A 11/1998 Carvalho et al.
2007/0286730 A1* 12/2007 Schmidt ..... 416/157 A
2008/0087014 A1* 4/2008 Schick et al. ..... 60/403

FOREIGN PATENT DOCUMENTS

| | | |
|---|---|---|
| DE | 1 403 498 | 7/1969 |
| DE | 43 31 825 | 11/1994 |
| DE | 196 00 660 | 7/1997 |
| DE | 43 31 825 | 7/1998 |
| EP | 0 103 042 | 3/1984 |

* cited by examiner

*Primary Examiner* — Michael Leslie

(74) *Attorney, Agent, or Firm* — Robert W. Becker; Robert Becker & Associates

(57) ABSTRACT

An apparatus for hydraulically adjusting the blades of an impeller of an axial-flow fan, comprising an adjustment cylinder that on both sides of a piston displaceably disposed in the cylinder has a first chamber and a second chamber respectively provided with a connection to control oil lines connected to four-way valves. Not only a feed line leading to one of the control oil lines, but also a return line connected to the other control oil line, is each divided into two parallel branch lines. Two redundant four-way valves are provided, each being disposed in one of the parallel branch lines. Disposed in each branch line of each control oil line, between the respective connection and the respective four-way valve, is a seat valve that closes by spring force.

11 Claims, 4 Drawing Sheets

APPARATUS FOR HYDRAULICALLY ADJUSTING THE BLADES OF AN IMPELLER OF AN AXIAL-FLOW FAN

The instant application should be granted the priority date of Mar. 9, 2007 the filing date of the corresponding German patent application DE 10 2007 011 990.0.

BACKGROUND OF THE INVENTION

The present invention relates to an apparatus for hydraulically adjusting the blades of an impeller of an axial-flow fan.

Modern axial-flow fans are regulatable work machines that convert mechanical energy into kinetic energy. The regulation of the axial-flow fans is effected via the speed or the angle of inclination of the blades. If during operation the blade position is to be able to be varied, the blades must be secured to a supported shaft, the spindle. The alteration of the blade position is generally undertaken hydraulically. For this purpose, a hydraulic adjustment or displacement mechanism is mounted on the impeller of the axial-flow fan. Such an adjustment mechanism is essentially comprised of a hydraulic adjustment cylinder, which rotates at the fan speed, and of a stationary oil delivery element, to which the oil supply lines are connected.

Due to the centrifugal forces of the blade caused by the rotation, enhanced by the geometrical shape of the blade profile, a torque, which acts as a restoring torque, results about the longitudinal axis of the spindle. If the adjustment mechanism fails during the operation, then the blade, due to this restoring torque, changes position in an abrupt manner, and the fan can no longer maintain pressure and conveying quantity. To prevent a change in position of the blades, counterweights can be mounted on each blade, generally however on the spindles, that more or less precisely compensate for the restoring torque. The drawback of such an approach is that the additional counterweights, due to the centrifugal force, effect a considerable overloading of the spindle mounting and make the impeller significantly heavier.

It is an object of the present invention to embody an apparatus of the aforementioned general type for the adjustment of blades during operation of the fan in such a way that even where there is a power failure the blade position can be maintained in the last position prior to such power failure until, by switching over the power, another control unit can take over the position regulation of the adjustment device.

SUMMARY OF THE INVENTION

The apparatus of the present invention for hydraulically adjusting the blades of an impeller of an axial-flow fan comprises an adjustment cylinder in which is displaceably disposed a piston, wherein the cylinder is provided with chambers on opposite sides of the piston and each chamber is provided with a connection to a control oil line that is respectively divided into two branch lines; a feed line leads to the branch lines of one of the control oil lines, wherein the feed line is divided into two parallel branch lines; a return line is connected to the branch lines of a second one of the control oil lines, wherein the return line is divided into two parallel branch lines; two redundant four-way valves are provided, each of which is disposed in one of the parallel branch lines of each of the feed line and the return line; and respective seat valves are disposed in each branch line of the first one of the control oil lines and in each branch line of the second one of the control oil lines, wherein the seat valves are disposed between the respective connection and the respective four-way valve.

As a result of the present invention, a redundant control of the adjustment device is made available. The arrangement of the seat valves upstream of the pertaining four-way valves ensures that always only one four-way valve carries out the control of the hydraulic adjustment device, and a hydraulic short circuit between the parallel arranged redundant four-way valves is precluded. By embodying the seat valves as valves that close by spring force there is additionally ensured that if the respective power supply of the parallel control units fails, a shutting off of the feed and return line not only to the hydraulic adjustment device but also to the respective four-way valves is effected, as a result of which the respective blade position is maintained until the power supply is again applied.

Further specific features and advantages of the present application will be described in detail subsequently.

BRIEF DESCRIPTION OF THE DRAWINGS

Various embodiments of the invention are explained in greater detail in the following and are illustrated in the drawings, in which.

DESCRIPTION OF SPECIFIC EMBODIMENTS

Figure 1A:
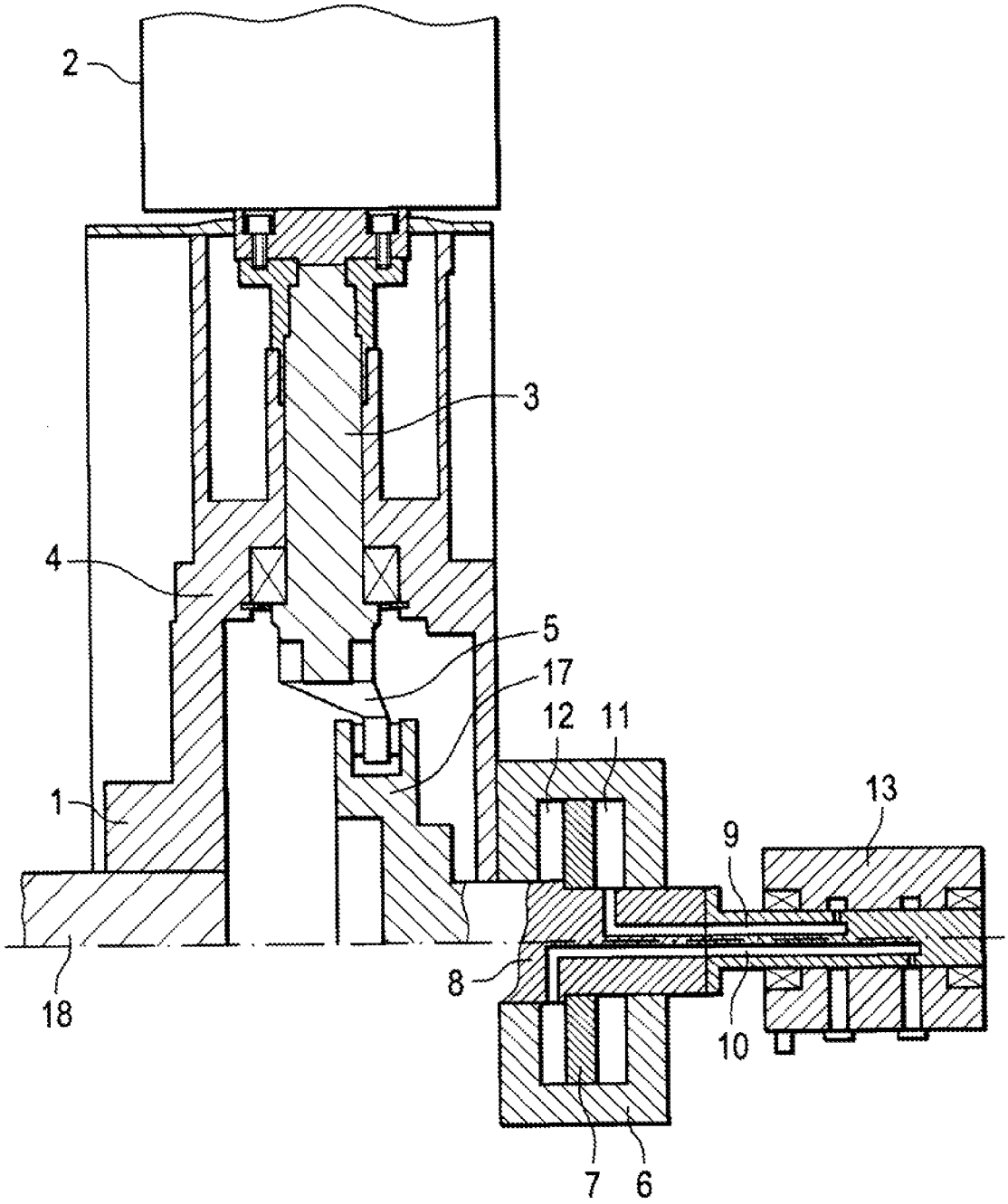
FIG. 1*a* is a longitudinal section through an impeller of an axial-flow fan having an adjustment mechanism pursuant to the invention.
Figure 1B:
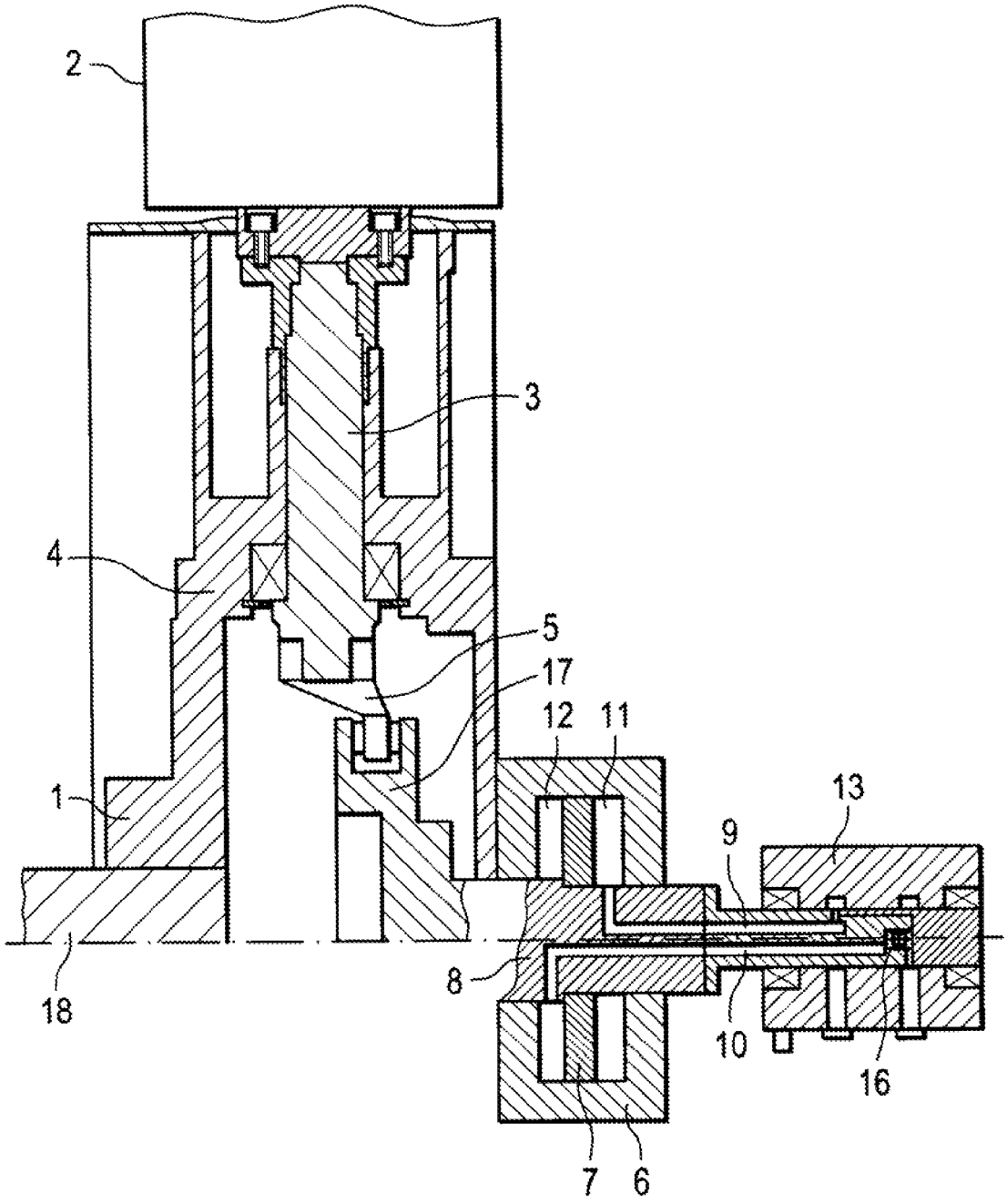
FIG. 1*b* is a longitudinal section through an impeller of an axial-flow fan having an adjustment mechanism pursuant to another embodiment.

FIG. 1 shows an impeller 1 of an axial-flow fan, wherein the impeller is provided with a plurality of blades 2 that are disposed on its periphery, with one of the blades being indicated. The impeller is secured to a shaft 18 that can be installed not only in a separate main bearing arrangement but also in a drive motor. For the adaptation of the axial-flow fan to various operating conditions, the blades 2 are adjustable about their longitudinal axes. For this purpose, a spindle 3 that supports the blades 2 is rotatably mounted in a bearing or support ring 4 of the impeller 1.

The impeller 1 is provided with a displacement mechanism for the adjustment of the blades 2. For this purpose, secured to each spindle 3 is an offset displacement or adjustment lever 5 that is guided in a groove provided on the periphery of a displacement or adjustment disk 17 shown in FIGS. 1*a* and 1*b*.

The displacement disk 17 is connected to a piston rod 8 that is secured to a piston 7. The piston 7 is disposed within an adjustment cylinder 6. The piston rod 8 along with the piston 7 and the displacement disk 17 are displaceably disposed along the axis of the axial-flow fan, and rotate at the same speed as do the impeller 1 and the adjustment cylinder 6.

The rearward end of the piston rod 8 is surrounded by an oil manifold element 13. With the embodiment illustrated in FIG. 1*b*, a check or nonreturn valve 16 is additionally disposed in the oil manifold element, the significance of which will be discussed subsequently.

Two axial control channels 9, 10 are guided through the piston rod 8 and respectively open out into a chamber 11, 12 provided on opposite sides of the piston 7. Depending upon which of the chambers 11 or 12 is supplied with pressure oil, the piston 7, together with the piston rod 8 and the displacement disk 17, are shifted toward the right or toward the left, hence rotating the spindle 3, together with the blade 2, into the one or other direction.

Figure 2A:
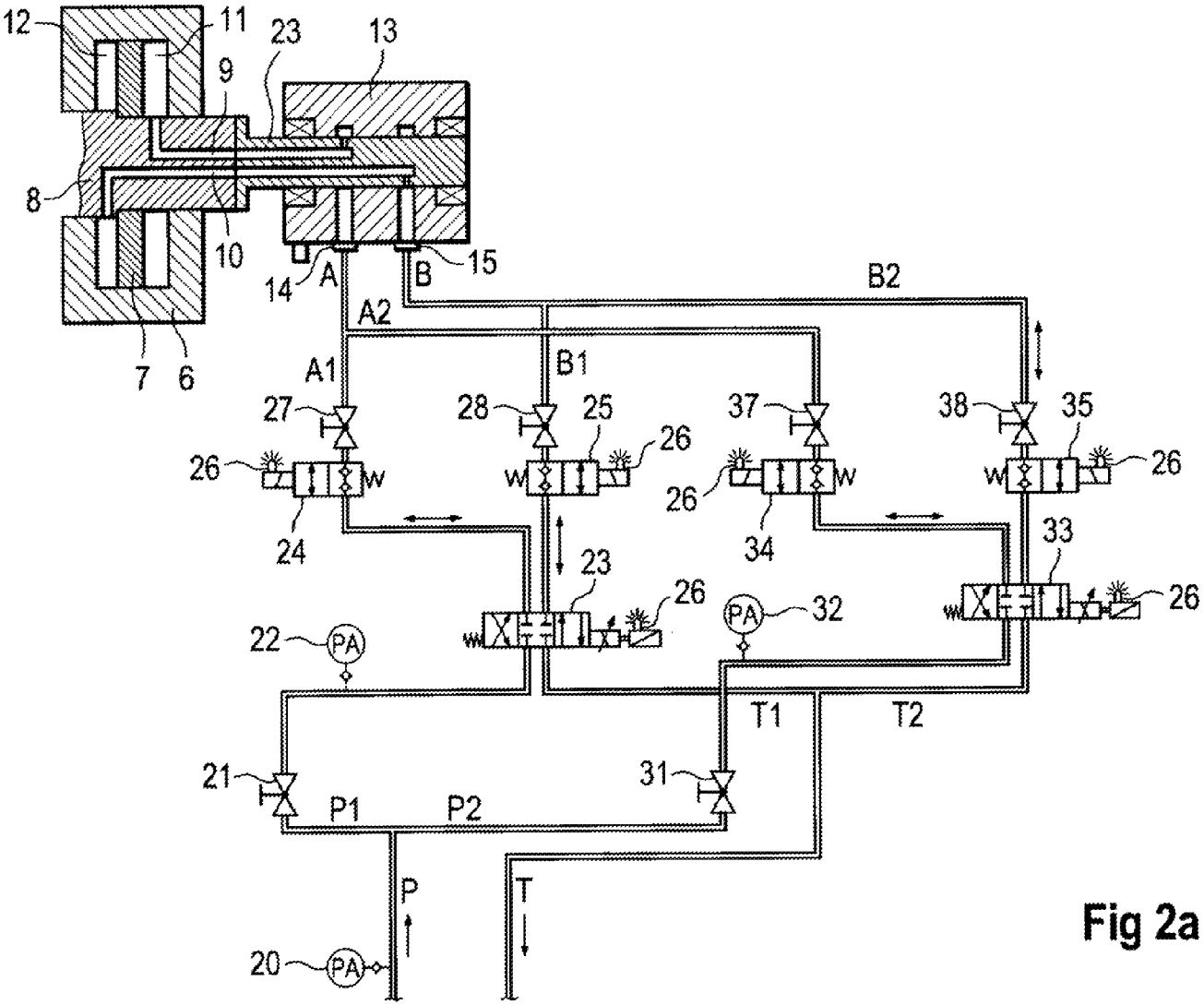
FIG. 2*a* is a circuit diagram for the control of the adjustment mechanism of FIG. 1*a*.
Figure 2B:
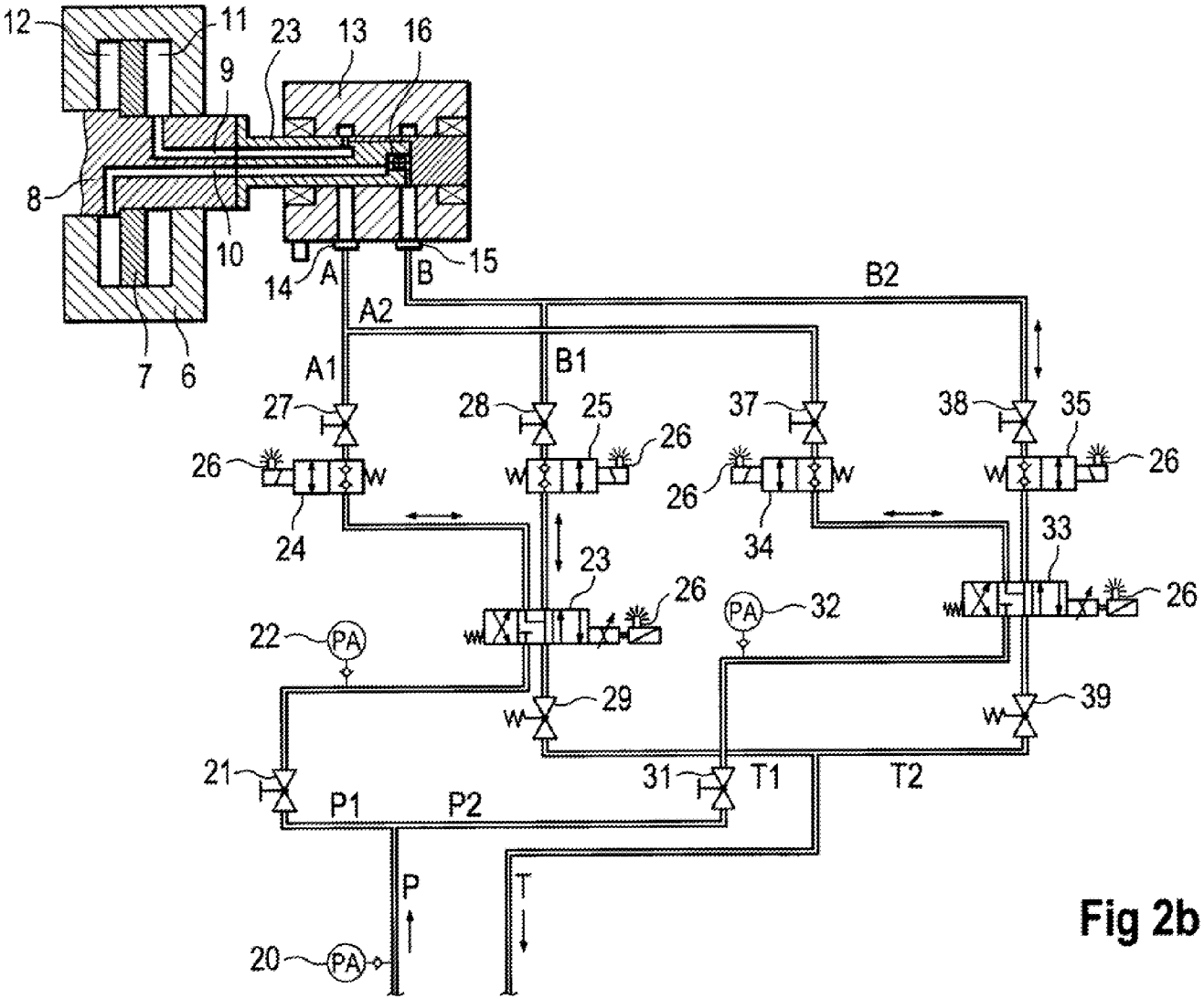
FIG. 2*b* is a circuit diagram for the control of the adjustment mechanism of FIG. 1*b*.

The control for the adjustment cylinder 6 is effected via a redundant control mechanism illustrated in FIGS. 2*a* and 2*b*. Not shown in FIGS. 2*a* and 2*b* is the oil station, which is comprised of oil pump, oil tank and accessories including instrumentation. The control mechanism is essentially configured as follows:

- a feed line P connects a non-illustrated oil pump to two four-way valves 23, 33 via two branch lines P1 and P2.
- a return line T connects the two four-way valves 23, 33 via two branch lines T1 and T2 to the non-illustrated oil tank.
- two control oil lines A, B, which are branched into branch lines A1 and A2 as well as into branch lines B1 and B2, connect the two four-way valves 23, 33 to the oil manifold element 13 via connections 14 and 15.

Installed in the feed line P is a test connection 20. By means of a quick-release coupling having a seat valve, the test connection 20 permits the connection of testing means to the feed line P. On the fan side of the test connection 20, the feed line P is equally divided into two parallel branch lines P1 and P2.

In FIGS. 2*a* and 2*b*, the flow direction of the control oil is indicated by arrows. In the direction of flow of the control oil, a respective manual shutoff valve 21, 31, which is preferably embodied as a ball valve, is installed in the two branch lines P1 and P2 of the feed line P. The purpose of the shutoff valves 21, 31 is, in the event that further valves that are disposed downstream are to be replaced, to be able to shut off the feed line P to these valves that conveys appropriate pressure. For the control of the flow in the branch lines P1, P2 of the feed line P, a respective test connection 22, 32 is provided on the fan side of the shutoff valves 21, 31.

The electromagnetically actuated four-way valve 23, 33 is respectively redundantly installed in one of the branch lines P1 or P2 of the feed line P and one of the branch lines T1 or T2 of the return line T.

Proceeding from the two four-way valves 23, 33 are two discharge lines T1 and T2 that are joined together to form the return line T. The return line T is connected to the non-illustrated oil tank.

The four-way valves 23, 33 are preferably embodied as 4/3-way proportional regulating valves. On the fan side, the branch lines A1 and B1 of the control oil lines A, B are connected to the four-way valve 23, while the branch lines A2 and B2 of the control oil lines A, B are guided on the fan side to the four-way valve 33.

Furthermore, on the fan side ahead of the four-way valves 23, 33, installed in each branch line A1, B1, A2, B2 is an electromagnetically actuated seat valve 24, 25, 34, 35, which is held in a closed position by spring force. The seat valves 24, 25, 34 25 are preferably embodied as 2/2-way conical seat valves. The seat valves 24, 25 serve as shutoff devices for the four-way valve 23 and the seat valves 34, 35 serve as shutoff devices for the four-way valve 33. The seat valves 24, 25, 34, 35 are respectively electrically coupled with the pertaining four-way valves 23, 33. The valves installed in the branch lines P1/A1 and T1/B1, namely four-way valve 23 and seat valves 24, 25, and the valves installed in the branch lines P2/A2 and T2/B2, namely four-way valves 33 and seat valves 34, 35, are connected to different power sources.

The four-way valves 23, 33 and the seat valves 24, 25, 34, 35 are each provided with a light-emitting diode 26 that is connected in such a way that it lights up as long as the pertaining valve is in operation.

To enable replacement of the seat valves 24, 25, 34, 35 during operation, a respective manual shutoff valve 27, 28, 37, 38 is installed downstream thereof that is preferably embodied as a ball valve; thus, replacement during operation with the redundant unit is possible without fluid pressure losses.

In order to realize the desired adjustment, the adjustment cylinder 6 can be supplied with the prescribed fluid quantities via the branch lines P1/A1/T1/B1 or via the branch lines P2/A2/T2/B2. The redundant control of the adjustment cylinder 6 is thus possible via either the one four-way valve 23 or the other four-way valve 33. If power is interrupted, the seat valves 24, 25, 34, 35 close in a spring-actuated manner. Therefore, without interrupting operation, it is possible to switch between the two four-way valves 23, 33 by changing the power supply. During the switching time, no fluid flows to or away from the adjustment cylinder 6. The position of the piston 7, and hence the position of the blades 2 that are adjustable by the adjustment cylinder 6, are maintained until the switching over is concluded and the power supply is again applied to one of the two four-way valves 23, 33. After one of the manually actuated shutoff valves 21, 31 has been closed, the respectively pertaining four-way valve 23, 33 that is not operating can be replaced. Should one of the seat valves 24, 25, 34, 35 be defective, after the manual shutoff by means of the respective shutoff valve 27, 28, 37, 38, the appropriately pertaining seat valve that is not operating can be replaced.

As shown in FIG. 2*b*, a pressure relief valve 29, 39 can be installed in the return lines T1, T2 that lead to the tank connection. Such a pressure relief valve 29, 39 is advantageous if a nonreturn valve 16 is disposed in the control oil line B immediately ahead of the connection 15 of the oil manifold element of the second chamber 12 of the adjustment cylinder 6. The nonreturn valve 16 is kept in the open position by the pressure in the control oil line A. If the pressure oil supply fails or is interrupted, the nonreturn valve 16 moves into the closed position. In the closed position of the nonreturn valve 16, the adjustment cylinder 6 remains in its previously assumed position. Thus, the blade 2, which is connected via the piston rod 8 and the displacement disk 17 and the spindle 3, cannot change its position, but rather remains in the assumed position.

The specification incorporates by reference the disclosure of German priority document 10 2007 011 990.0 filed Mar. 9, 2007.

The present invention is, of course, in no way restricted to the specific disclosure of the specification and drawings, but also encompasses any modifications within the scope of the appended claims.

We claim:

1. An apparatus for hydraulically adjusting the blades (2) of an impeller of an axial-flow fan, comprising:

an adjustment cylinder in which is displaceably disposed a piston, wherein said adjustment cylinder is provided with a first chamber and a second chamber on opposite sides of said piston, and wherein each of said chambers is provided with a connection to a control oil line that is respectively divided into two branch lines;

a feed line that leads to said branch lines of a first one of said control oil lines, wherein said feed line is divided into two parallel branch lines;

a return line that is connected to said branch lines of a second one of said control oil lines, wherein said return line is divided into two parallel branch lines;

two redundant four-way valves, each of which is disposed in one of said parallel branch lines of each of said feed line and said return line; and respective seat valves disposed in each branch line of said first one of said control oil lines and in each branch line of said second one of said control oil lines, wherein said seat valves are disposed between the respective connection and the respective four-way valve.

2. An apparatus according to claim 1, wherein each of said seat valves is embodied as a seat valve that is adapted to close by spring force.

3. An apparatus according to claim 1, wherein a manually actuatable shutoff valve is disposed in each of said two branch lines of said feed line upstream of the respective four-way valve as viewed in a direction of flow of control oil.

4. An apparatus according to claim 1, wherein a manually actuatable shutoff valve is disposed in each of said branch lines of said control oil lines as viewed in a direction of flow of control oil.

5. An apparatus according to claim 1, wherein said four-way valves are embodied as 4/3-way proportional regulation valves.

6. An apparatus according to claim 1, wherein said seat valves are embodied as 2/2-way conical seat valves.

7. An apparatus according to claim 1, wherein a common test connection is disposed in said feed line prior to its division into said two branch lines.

8. An apparatus according to claim 1, wherein said four-way valves and said seat valves are provided with a light-emitting diode.

9. An apparatus according to claim 1, wherein said four-way valves are electrically coupled with said seat valves.

10. An apparatus according to claim 1, wherein said four-way valves and said seat valves are connected to one another.

11. An apparatus according to claim 1, wherein a pressure relief valve is disposed in each of said branch lines of said return line, wherein an oil manifold element is provided at the connection of said second one of said control oil lines, wherein a nonreturn valve is disposed in said connection of said oil manifold element, and wherein said nonreturn valve is adapted to be held in an open position by pressure in said feed line.

* * * * *